US005505294A

United States Patent [19]

Kilmartin, III et al.

[11] Patent Number: 5,505,294

[45] Date of Patent: Apr. 9, 1996

[54] STACKABLE DISPLAY

[75] Inventors: John D. Kilmartin, III, Providence; Joseph G. Lefebvre, Barrington; John M. Lopez, Pawtucket, all of R.I.

[73] Assignee: International Packaging Corporation, Pawtucket, R.I.

[21] Appl. No.: 388,724

[22] Filed: Feb. 15, 1995

[51] Int. Cl.[6] ..... B65D 85/02; B65D 21/032

[52] U.S. Cl. ..... 206/6.1; 206/503; 206/509; 206/566

[58] Field of Search ..... 206/6.1, 503, 509, 206/566; 220/4.26, 4.28

[56] References Cited

U.S. PATENT DOCUMENTS

| | | | |
|---|---|---|---|
| 3,209,903 | 10/1965 | Shiffman | 206/562 |
| 3,672,495 | 6/1972 | Bauer et al. | 220/4.27 |
| 3,719,272 | 3/1973 | Bodine et al. | 220/4.27 |
| 3,804,239 | 4/1974 | O'Brien | 206/503 |
| 4,282,975 | 8/1981 | Ovadia | 206/566 |
| 4,917,235 | 4/1990 | Feiler | 206/6.1 |
| 4,993,545 | 2/1991 | Feiler | 206/6.1 |
| 5,273,153 | 12/1993 | Braun | 206/6.1 |

*Primary Examiner*—Jimmy G. Foster
*Attorney, Agent, or Firm*—Salter & Michaelson

[57] ABSTRACT

A stackable display includes a frame having an inwardly extending ledge, an upper edge portion, a lower edge portion, and an opening. The display also includes an upwardly facing top tray and a downwardly facing bottom tray each disposed within the opening of the frame. The top and bottom trays each have a horizontally disposed wall and at least one side wall attached to the horizontal wall at its outer peripheral edge. The side wall of the top tray is offset relative to the upper edge portion of the frame to define an upper interengageable formation. The side wall of the bottom tray is offset relative to the lower edge portion of the frame to define a lower mating interengageable formation which is adapted to interengage with the upper interengageable formation of a next adjacent display construction so as to assemble the display in nested, stacked relation. A strip of adhesive material positioned between the top and bottom trays attaches them to one another for maintaining the frame, top tray and bottom tray in assembled relation. An insert is received within the top tray for displaying articles.

11 Claims, 4 Drawing Sheets

STACKABLE DISPLAY

BACKGROUND AND SUMMARY OF THE INVENTION

This invention relates generally to displays and more particularly to a stackable display suitable for displaying articles, such as jewelry.

Stackable displays which display jewelry, such as rings, have been available for quite some time. A typical prior art stackable display comprises an outer frame and a synthetic resin insert having a cushioned layer with slots arranged in a staggered pattern, the slots receiving a ring therein which is standing on edge. One disadvantage associated with many of these prior art stackable displays is that the insert must be specifically designed so that there is sufficient space between adjacent inserts of adjacent stacked displays for receiving the ring. Oftentimes a complicated insert design is provided for ensuring rings on adjacent displays are offset. These insert designs are costly to design and manufacture thereby increasing the overall cost of the display.

Accordingly, among the several objects of the present invention are the provision of an improved stackable display capable of displaying and storing rings standing on edge; the provision of such a stackable display which is stackable with identically constructed displays; the provision of such a stackable display capable of displaying and storing earrings; the provision of such a stackable display which is of simple design and construction; the provision of such a stackable display which is cost-efficient to manufacture; the provision of such a stackable display which is light-weight; the provision of such a stackable display which has a neat, clean, attractive appearance; and the provision of such a stackable display which is easy to assemble.

In general, a stackable display of the present invention comprises a frame having walls which combine to define an opening, each wall having an upper edge portion, and a lower edge portion, and an inwardly extending, horizontal ledge. An upwardly facing top tray is disposed within the opening of the frame and has a horizontally disposed wall which rests upon the ledge of the frame, and at least one upwardly projecting side wall attached to the horizontal wall at its outer peripheral edge. The side wall of the top tray has an upper edge portion which extends along a plane generally parallel to the plane of the frame and is sized to be snugly received within the opening of the frame. The side wall of the top tray is downwardly offset relative to the upper edge portion of the frame to define an upper interengageable formation. A downwardly facing bottom tray is disposed within the opening of the frame, the bottom tray having a horizontally disposed wall which bears against the ledge of the frame and at least one downwardly projecting side wall attached to the horizontal wall at its outer peripheral edge. The side wall of the bottom tray has a lower edge portion which extends along a plane generally parallel to the plane of the frame and is sized to be snugly received within the opening of the frame. The side wall of the bottom tray is downwardly offset relative to the lower edge portion of the frame to define a lower mating interengageable formation which is adapted to interengage with the upper interengageable formation of a next adjacent display of identical construction. A strip of adhesive material has an upper adhesive surface for engaging the top tray and a lower adhesive surface for engaging the lower tray. The strip of adhesive material attaches the top tray and the bottom tray to one another for maintaining the frame, top tray and bottom tray in assembled relation. An insert is received within the top tray for displaying articles.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

Corresponding reference numerals designate corresponding parts throughout the several views of the drawings.

DETAILED DESCRIPTION OF THE PREFERRED EMBODIMENTS

Figure 1:
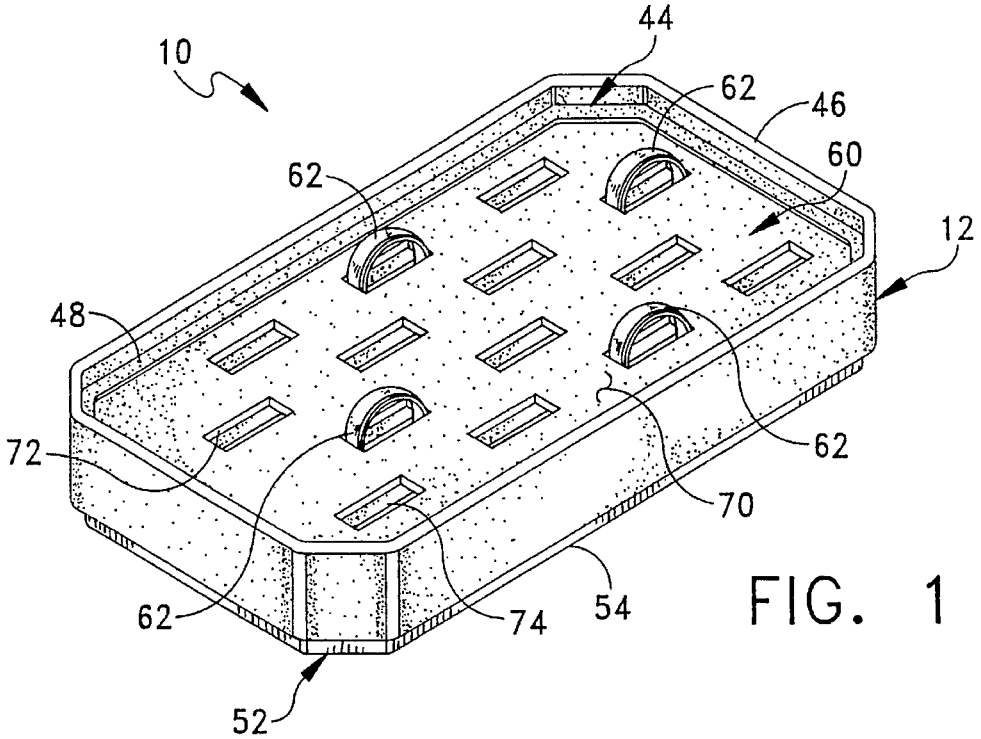
FIG. 1 is a perspective view of a stackable display of the present invention.

Referring now to the drawings, there is generally indicated at 10 a stackable display of the present invention which is capable of displaying and stacking articles, such as jewelry. FIGS. 1–4 illustrate a stackable display 10 which is especially suited for displaying rings and FIG. 5 illustrates a stackable display 10 of an alternative embodiment which is especially suited for displaying earrings.

Figure 2:
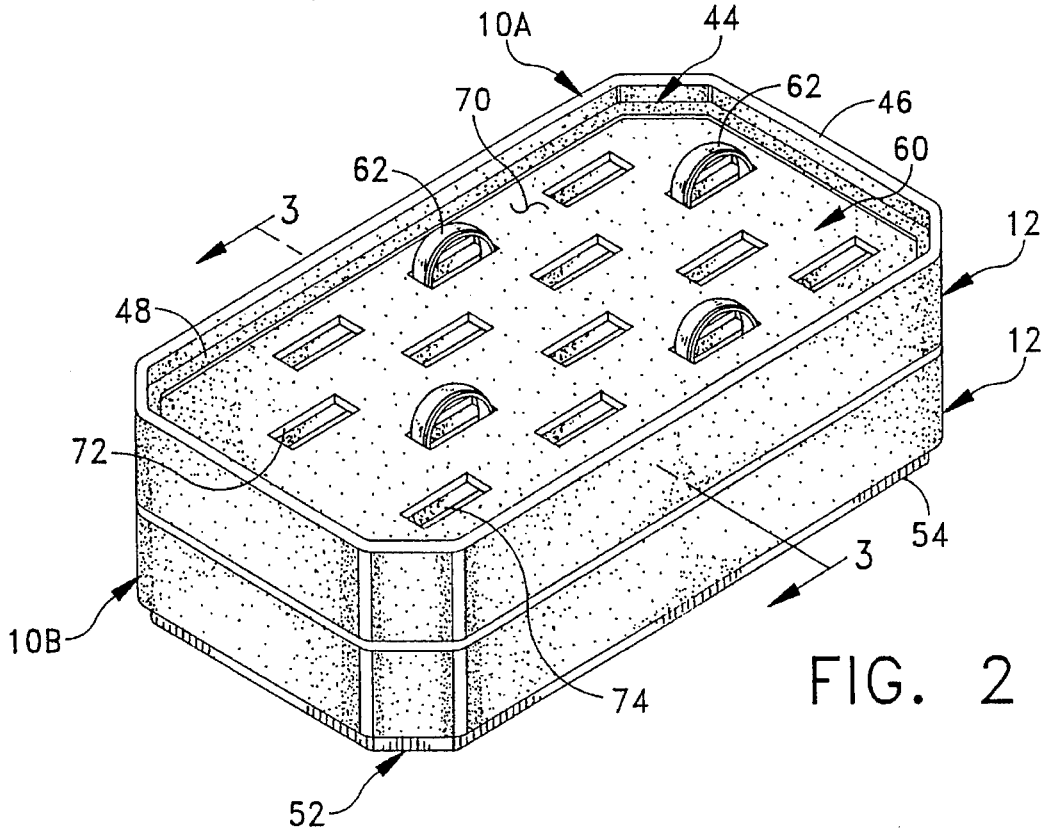
FIG. 2 is a perspective view of two stackable displays in stacked, nested relation.
Figure 3:
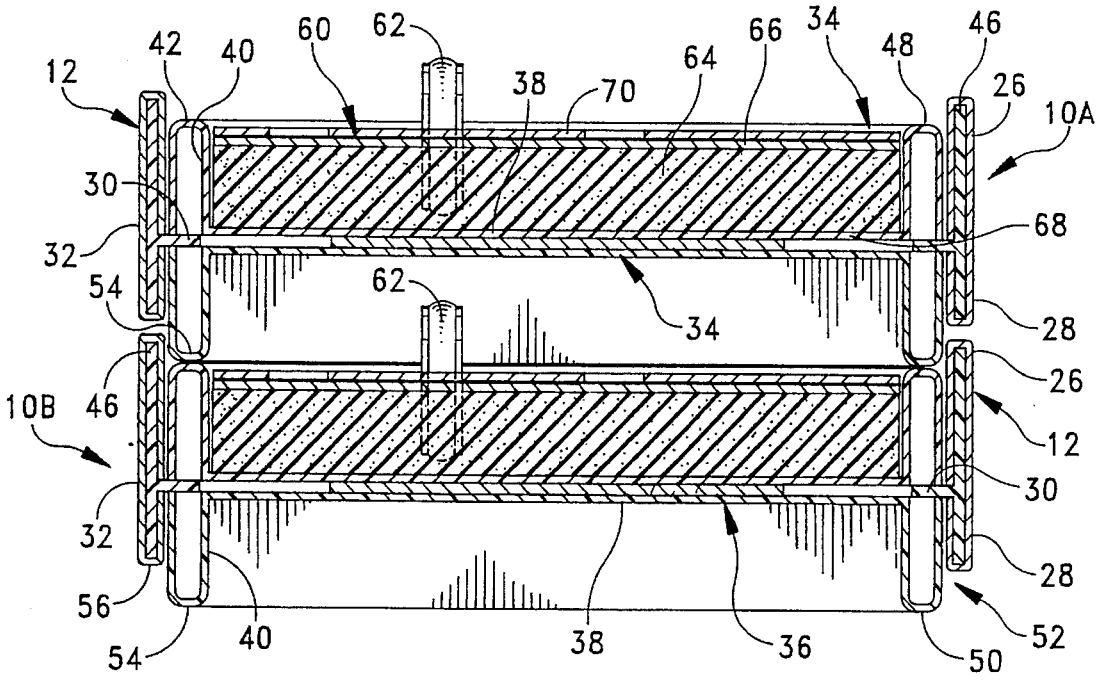
FIG. 3 is an elevational cross section view taken along line 3—3 in FIG. 2.
Figure 4:
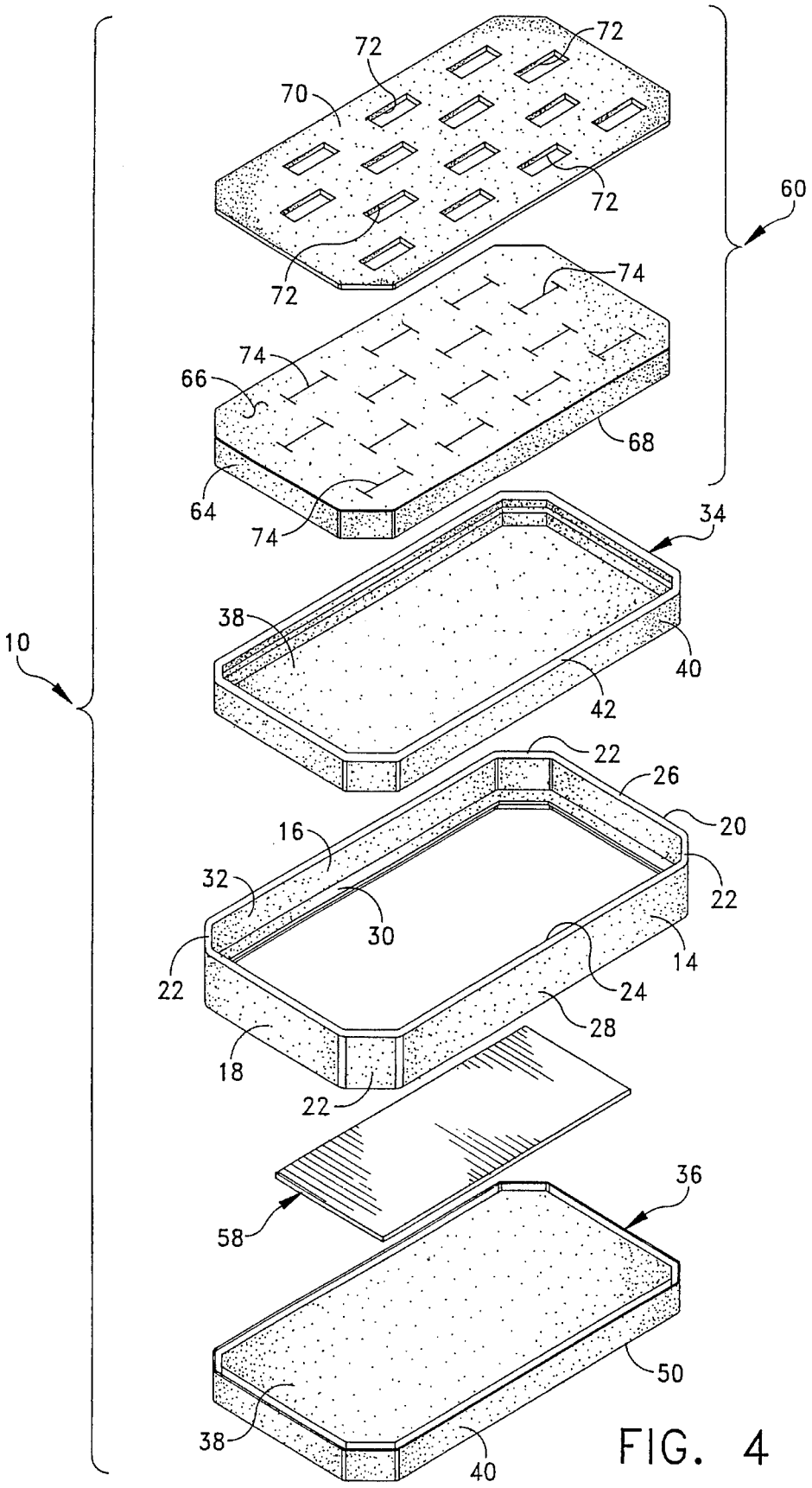
FIG. 4 is an exploded perspective view of the stackable display.
Figure 5:
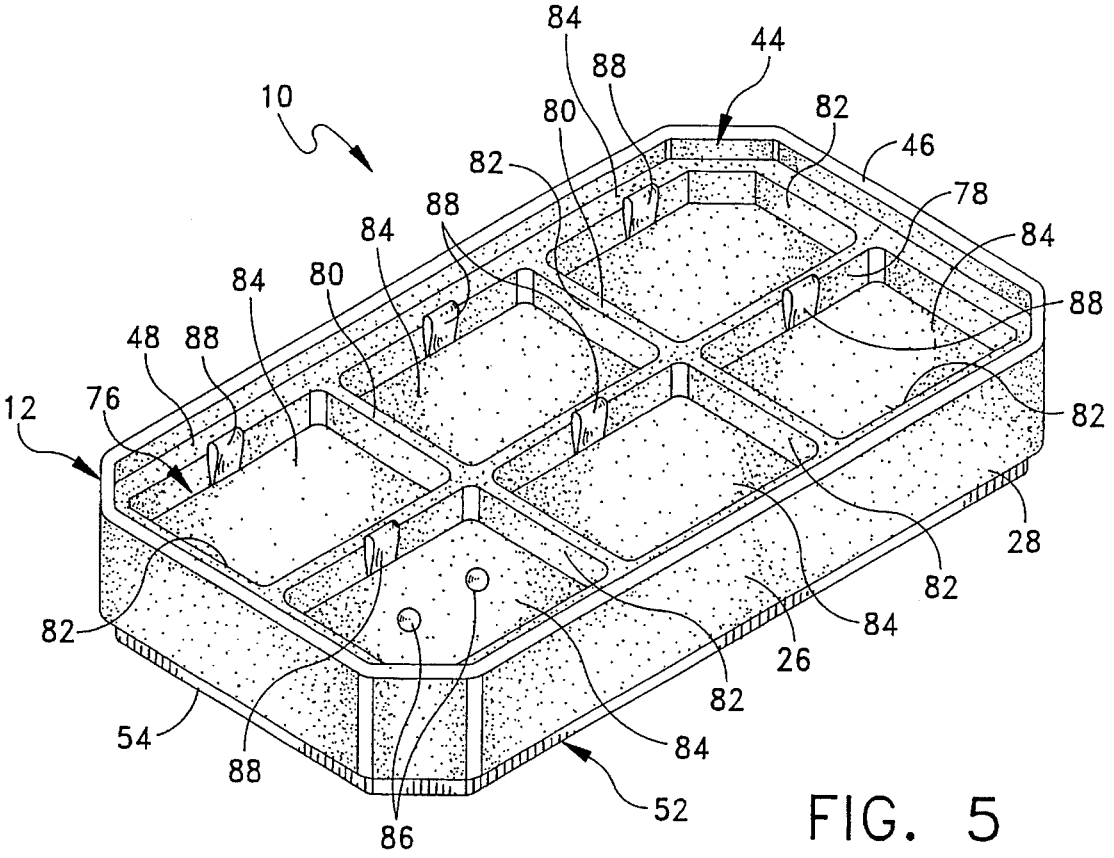
FIG. 5 is a perspective view of a stackable display of an alternative embodiment.

Turning generally to FIGS. 1–4, and more particularly to FIGS. 3 and 4, the stackable display 10 comprises an outer frame, generally indicated at 12, which, as illustrated in the drawings, is octagonal as viewed from above. It should be understood that the frame 12 may take the form of any shape (e.g., rectangle, square, etc.) and that the provision of an octagonal frame is merely illustrative. The frame 12 has two side walls 14, 16, two end walls 18, 20 and four interconnecting portions each indicated at 22 which interconnect adjacent side and end walls, the side walls 14, 16, end walls 18, 20 and interconnecting portions 22 defining a generally rectangular-shaped opening 24, although in the specific form illustrated, the opening 24 is actually octagonal. Each wall and interconnecting portion of the frame includes an upper edge portion 26 and a lower edge portion 28 which will be described in greater detail below. The frame 12 also comprises an inwardly extending, horizontal ledge 30 which functions to support other components of the stackable display. The ledge 30 is located below the midpoint of the walls 14, 16, 18, and 20 of the frame, the importance of which will be described below.

Preferably, the frame 12 is fabricated from synthetic resin material by an injection mold process. As best illustrated in FIG. 3, the walls 14, 16, 18 and 20 and interconnection portions 22 of the frame 12 are wrapped with synthetic sheathing material 32 which gives the frame the appearance of a fine jewelry display case.

The stackable display 10 further comprises an upwardly facing top tray, generally indicated at 34, and a downwardly facing bottom tray, generally indicated at 36, each being disposed within the opening 24 of the frame 12. As illustrated in FIGS. 3 and 4, the top and bottom trays 34, 36 are of identical construction whereby the top tray is interchangeable with the bottom tray 36. The top and bottom trays 34, 36 each have a horizontally disposed wall 38 and eight upwardly projecting side walls (forming the shape of an octagon) which are integrally attached to each other to form one upwardly projecting side wall indicated at 40, the side wall 40 being attached to the horizontal wall 38 at its outer peripheral edge. Preferably, the trays 34, 36 are fabricated from synthetic resin material by a thermoforming process, the interior surfaces of the trays (i.e., the upper surface of the horizontal wall 38 and the inner surface of the side wall 40) being textured with synthetic material in order to give these surfaces a finished look.

The side wall 40 of the top tray 34 extends along a plane parallel to the plane of the walls 14, 16, 18 and 20 and interconnecting portions 22 of the frame 12 and is sized to be snugly received within the opening 24 of the frame 12 in a position where the horizontal wall 38 of the top tray 34 bears against the ledge 30 of the frame 12. As illustrated in FIG. 3, the side wall 40 of the top tray 34 has an inverted U-shaped cross section (note that the side wall 40 of the bottom tray 36 has a U-shaped cross section) which enables the side wall 40 to resiliently engage the frame 12 when it is inserted within the opening 24 of the frame 12. The top tray 34 is inserted in the opening 24 of the frame 12 in such a manner that the horizontal wall 38 of the top tray 34 engages the ledge 30 and an upper edge portion 42 of the side wall 40 is downwardly offset relative to the upper edge portion 26 of the frame 12 to define an upper interengageable formation, generally designated at 44. Referring particularly to FIG. 3, the upper interengageable formation 44 comprises an upwardly extending vertical lip 46 formed by the upper edge portion 26 of the frame 12 and an inwardly extending, horizontal shoulder portion 48 formed at the junction of the upper edge portion 42 of the side wall 40 of the top tray 34 and the upper edge portion 26 of the frame 12. The width of the side wall 40 is approximately one half the width of the frame walls, and since the ledge 30 of the frame 12 is located below the midpoint of the walls of the frame 12, this offset distance defines the extension of the lip 46 above the shoulder portion 48.

The bottom tray 36 is inserted in the opening 24 of the frame 12 in such a manner that the horizontal wall 38 of the bottom tray 34 bears against the ledge 30 of the frame 12 and a lower edge portion 50 of the side wall 40 is downwardly offset relative to the lower edge portion 28 of the frame 12 to define a lower interengageable formation, generally designated at 52, which interengages the upper interengageable formation 44 of a next adjacent display to substantially prevent any relative lateral and longitudinal movement when the two displays (the top display being indicated 10A and the bottom display being indicated 10B in FIGS. 2 and 3) of identical construction are in nested, stacked relation.

More specifically, the lower edge portion 50 of the side wall 40 of the bottom tray 36 is spaced below the lower edge portion 28 of the frame 12 for forming the lower interengageable formation 52. Referring to FIG. 3, for each display 10A and 10B, the lower interengageable formation 52 comprises a downwardly extending vertical lip 54 formed by the lower edge portion 50 of the side wall 40 of the bottom tray 36 and an outwardly extending, horizontal shoulder portion 56 formed at the junction of the lower edge portion 50 of the side wall 40 of the bottom tray 36 and the lower edge portion 28 of the frame 12. Since the ledge 30 of the frame 12 is located below the midpoint of the walls of the frame 12, this distance defines the extension of the lip 54 below the shoulder portion 56.

As shown in FIG. 3, for each pair of displays 10A and 10B, the horizontal wall 38 of the top tray 34 and the horizontal wall 38 of the bottom tray 36 are in proximate, face-to-face relation. Each display further comprises a strip of adhesive material, generally indicated at 58, having an upper adhesive surface for engaging the top tray 34 and a lower adhesive surface for engaging the lower tray 36. The strip of adhesive material 58 attaches the top tray 34 and bottom tray 36 to one another for maintaining the frame 12, top tray 34 and bottom tray 36 in assembled relation. It should be noted that the ledge 30 of the frame 12 is sandwiched between the interlocked top and bottom trays 34, 36 thereby locking them to the frame 12. The strip of material 58 has a thickness approximate to the thickness of the ledge 30 to fill-in the space between the top and bottom trays 34, 36. The strip of adhesive material 58 can be selected from any suitable two-sided adhesive tapes presently available.

The arrangement is such that when stacking two stackable displays 10A and 10B as illustrated in FIGS. 2 and 3, the lower formation 52 of the top display 10A interengages the upper formation 44 of the bottom display 10B in such a manner that the upwardly extending lip 46 of the upper formation 44 of the bottom display 10B engages the downwardly extending lip 54 of the lower formation 52 of the top display 10A thereby preventing any side-to-side and back-and-forth relative movement between the top and bottom displays 10A, 10B. Also, the shoulder portion 48 of the upper formation 44 of the bottom display 10B abuts the shoulder portion 56 of the lower formation 52 of the top display 10A for properly seating the top display 10A on the bottom display 10B in nested, stacked relation.

The display 10 of the present invention further comprises an insert, generally indicated at 60, received within the top tray 34 for displaying articles. In the embodiment illustrated in FIGS. 1–4, and referring particularly to FIGS. 3 and 4, the insert 60 is suited for displaying rings 62 standing on edge, the insert 60 comprising a foam pad 64 having a top surface 66 and a bottom surface 68, and a top sheet 70 of semi-rigid material such as cardboard attached (e.g., by adhesive) to the pad 64. The top sheet 70 is covered with felt-like material for producing an attractive, clean look. The pad 64 and top sheet 70 are shaped to be received within the top tray 34, the bottom surface 68 being attached to the horizontal wall 38 of the top tray 34 by suitable adhesive.

The top sheet 70 has a plurality of staggered slots 72 formed therein, each slot 72 being sized to receive ring shanks 62 therethrough. The pad 64 has a plurality of slits 74 formed therein which correspond to the location of the slots 72 of the sheet 70. Thus, by inserting the ring shanks 62 through the slots 72 in the sheet 70 and through the slits 74 until the rings 62 are proximate to the horizontal wall 38 of the top tray 34, the rings 62 are maintained on edge for displaying purposes in a manner well known in the art. As illustrated in FIG. 3, the space between the horizontal wall 38 of the bottom tray 36 of the top display 10A and the horizontal wall 38 of the top tray 34 of the bottom display 10B is sufficient to store the ring 62 therein without it interfering with the horizontal wall 38 of the bottom tray 36 of the top display 10A.

Turning now to FIG. 5, an insert 76 of an alternate embodiment is integrally formed with the top tray 34 and comprises a plurality of upwardly extending walls (i.e., one wall 78 which extends from end to end and two walls 80 which extend from side to side) which combine with the side wall 40 of the top tray 34 to define a plurality of compartments (i.e., six compartments), each indicated at 82, suitable for displaying articles. As shown, each compartment 82 receives a pad 84 of cushion material therein which is constructed and arranged for displaying earrings 86 in a conventional fashion. A loop 88 of material is attached to the pad 84 for facilitating removal of the pad from its respective compartment 82.

It should be observed that the stackable display 10 of the present invention is relatively easy to assemble wherein the upwardly facing top tray 34 and downwardly facing bottom tray 36 are inserted into the opening 24 of the frame 12 so that their respective horizontal walls 38 bear against the ledge 30 of the frame 12 and are attached to one another by the strip of adhesive material 58 for maintaining the frame 12, top tray 34 and bottom tray 36 in assembled relation. Since the ledge 30 is positioned below the midpoint of the walls of the frame 12, the upper edge portion 42 of the top tray 34 is spaced below the upper edge portion 26 of the frame 12 and the lower edge portion 50 of the bottom tray 36 extends beyond the lower edge portion 28 of the frame 12. After attaching the top and bottom trays 34, 36 to the frame 12, the insert 60 of FIGS. 1–4 is positioned in the top tray and attached thereto by suitable adhesive. In the alternative embodiment illustrated in FIG. 5, the insert 76 is integral with the top tray 34 and only the pads 84 need be inserted in the compartments 82 formed in the top tray.

It should also be observed that the stackable display 10 of the present invention is especially suited for displaying and stacking rings 62 on edge wherein there is a sufficient space between the horizontal wall 38 of the bottom tray 34 of the top display 10A and the horizontal wall 38 of the top tray 34 of the bottom display 10B to receive the rings 62. Other prior art displays have had to specifically design the display to accommodate the rings.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A stackable display suitable for displaying articles, such as jewelry, comprising:

a frame having walls which combine to define an opening, each wall having an upper edge portion, and a lower edge portion, and an inwardly extending, horizontal ledge;

an upwardly facing top tray disposed within said opening of the frame, said top tray having a horizontally disposed wall which rests upon the ledge of the frame and at least one upwardly projecting side wall attached to the horizontal wall at its outer peripheral edge, said side wall of the top tray having an upper edge portion, said side wall of the top tray extending along a plane generally parallel to the plane of the frame and being sized to be snugly received within the opening of the frame, the upper edge portion of said side wall being downwardly offset relative to the upper edge portion of the frame to define an upper interengageable formation;

a downwardly facing bottom tray disposed within said opening of the frame, said bottom tray having a horizontally disposed wall which bears against the ledge of the frame and at least one downwardly projecting side wall attached to the horizontal wall at its outer peripheral edge, said side wall of the bottom tray having a lower edge portion, said side wall of the bottom tray extending along a plane generally parallel to the plane of the frame and being sized to be snugly received within the opening of the frame, the lower edge portion of said side wall of the bottom tray being downwardly offset relative to the lower edge portion of the frame to define a lower mating interengageable formation which is adapted to interengage with the upper interengageable formation of a next adjacent display of identical construction;

a strip of adhesive material having an upper adhesive surface for engaging the top tray and a lower adhesive surface for engaging the lower tray, said strip of adhesive material being positioned between the horizontal walls of the top and bottom trays for attaching the top tray and the bottom tray to one another and for sandwiching said ledge of the frame therebetween to maintain said frame, top tray and bottom tray in assembled relation; and an insert received within the top tray for displaying articles.

2. A stackable display as set forth in claim 1, said strip of material having a thickness approximate to the thickness of the ledge of the frame.

3. A stackable display as set forth in claim 1, the top tray and the bottom tray being of identical construction whereby the top tray is interchangeable with the bottom tray.

4. A stackable display as set forth in claim 1, said insert comprising a pad having an upper surface and a top sheet of semi-rigid material attached to the upper surface of the pad, said cushion and top sheet being received within the top tray.

5. A stackable display as set forth in claim 4, said top sheet having a plurality of slots formed therein and said pad having a plurality of slits formed therein in alignment with the slots of the sheet, said insert being adapted to display articles, such as rings having circular shanks, whereby the ring shanks are frictionally received by the aligned slots and slits.

6. A stackable display as set forth in claim 1, said insert being integrally formed with said top tray, said insert comprising a plurality of upwardly extending walls which combine with the side wall of the top tray to define a plurality of compartments suitable for displaying articles.

7. A stackable display as set forth in claim 6, each compartment receiving a pad of cushion material therein which is constructed and arranged for displaying articles, such as earrings.

8. A stackable display as set forth in claim 1, said frame, top tray and bottom tray being fabricated from synthetic resin material.

9. A stackable display as set forth in claim 8, said frame being wrapped with synthetic sheathing material.

10. A stackable display as set forth in claim 8, said top and bottom trays being textured.

11. A stackable display as set forth in claim 1, said ledge being located below the midpoint of the walls of the said frame.

* * * * *